United States Patent [19]

Roberts

[11] Patent Number: 4,884,178

[45] Date of Patent: Nov. 28, 1989

[54] INDIRECT LIGHTING FIXTURE

[76] Inventor: James R. Roberts, 4501 N. Western, Oklahoma City, Okla. 73118

[21] Appl. No.: 322,006

[22] Filed: Mar. 13, 1989

[51] Int. Cl.[4] ..... F21V 1/00

[52] U.S. Cl. ..... 362/241; 362/249; 362/800

[58] Field of Search ..... 362/151, 241, 249, 227, 362/219, 225, 217, 806, 800

[56] References Cited

U.S. PATENT DOCUMENTS

| | | | |
|---|---|---|---|
| 3,404,268 | 10/1968 | Fowler | 240/10 |
| 4,143,411 | 3/1979 | Roberts | 362/145 |
| 4,152,622 | 5/1979 | Fitzgerald | 313/318 |
| 4,398,240 | 8/1983 | Savage, Jr. | 362/311 |
| 4,439,818 | 3/1984 | Scheib | 362/250 |
| 4,471,415 | 9/1984 | Larson et al. | 362/250 |
| 4,482,944 | 11/1984 | Roossine et al. | 362/418 |

*Primary Examiner*—Carroll B. Dority

*Attorney, Agent, or Firm*—Laney, Dougherty, Hessin & Beavers

[57] ABSTRACT

An indirect lighting fixture for use with a series of parallel-connected lamp assemblies that consists of a mounting member of pre-selected length having a base and opposite light-directing side panels, and an insert strip for retention within the mounting member to support the series of lamp assemblies while still allowing individual lamp replacement.

6 Claims, 2 Drawing Sheets

INDIRECT LIGHTING FIXTURE

BACKGROUND OF THE INVENTION

1. Field of the Invention

The invention relates generally to lighting fixtures and more particularly, but not by way of limitation, it relates to an improved form of indirect lighting fixture for utilizing such as a low voltage light strip to provide the requisite illumination.

2. Description of the Prior Art

The prior art includes a great number of diverse types of lighting fixture and in relatively recent years the plural lamp types of fixture have developed. A Pat. No. 4,143,411 in the name of Roberts provides one of the earlier teachings as regards plural lamp fixtures for use in ornamental and indirect lighting applications. U.S. Pat. No. 4,471,415 teaches a particular form of mounting strip for receiving a plurality of spaced indicator lights. This device has been specifically developed for positioning and array of LED modules for connection to a printed circuit board or the like. A U.S. Pat. No. 4,482,944 appears to be the closest prior teaching as this device utilizes a light strip assembly that is adapted for support within a raceway, cover and mounting bracket combination. This patent deals with the basic multi-lamp strip as contained within a form of raceway and cover that can then be retained in position by snap-fit into a mounting bracket. This is a direct lighting fixture.

SUMMARY OF THE INVENTION

The present invention relates to improvements in plural lamp lighting arrays, particularly the type utilized in indirect lighting applications. The structure utilizes a U-shaped mounting member having a flat mounting base and perpendicular sides that are angled and adjustable as to length in order to achieve best reflection characteristics. A flexible light strip is then contained within an insert strip which includes a plurality of holes for receiving respective lamps therethrough and which strip is formed for snap-fit down within the mounting member. The assembled plural lamp fixture may then be suitably secured in an indirect lighting position, e.g., within cove molding, bookcases and the like.

Therefore, it is an object of the present invention to provide a low voltage, plural lamp fixture that is capable of extra long life service.

It is yet another object to provide a plural lamp light strip that functions with low voltage and allows individual lamp replacement without undue precaution.

It is also an object of the present invention to provide a light fixture that is compact, rigid and capable of being secured within relatively narrow confines for indirect lighting applications.

Finally, it is an object of the invention to provide a high reliability plural lamp light fixture that may be trimmed or adjusted to achieve most desirable reflection results when used in diverse lighting applications.

Other objects and advantages of the invention will be evident from the following detailed description when read in conjunction with the accompanying drawings which illustrate the invention.

DETAILED DESCRIPTION OF THE INVENTION

Figure 1:
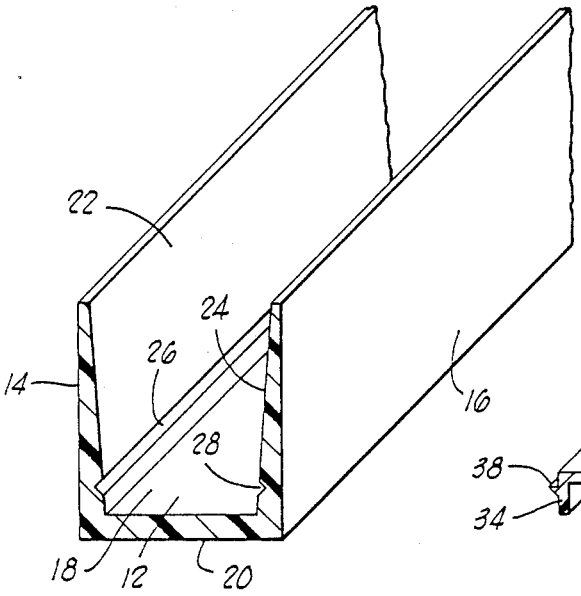
FIG. 1 is a perspective view of a portion of a mounting member constructed in accordance with the invention.

FIG. 1 illustrates a mounting member 10 which is a unitarily formed member that includes a base panel 12 and side panels 14 and 16. Mounting member strips may be extruded from a suitable plastic such as PVC polymer, and such extruded members may be formed in any lengths that are workable for specific applications or as dictated by commercial considerations. The base panel includes an inner surface 18 and a mounting or outer surface 20 and mounting may be effected by suitable adhesives, screws or other fasteners. The side walls 14 and 16 are formed in parallel but include respective inner surfaces 22 and 24 that may be formed at a slightly diverging angle proceeding from base surface 18.

A pair of angular grooves 26 and 28 are formed proximate and equi-distant from base inner surface 18 along the respective side panel inner surfaces 22 and 24. The grooves 26 and 28 are formed at a selected height from inner surface 18 in order to accommodate a selected height of insert strip 30 (FIG. 2), as will be further described. The side walls 14 and 16 are formed in contemplation of trimming their height variously for certain applications thereby to adjust unit reflectivity.

Figure 2:
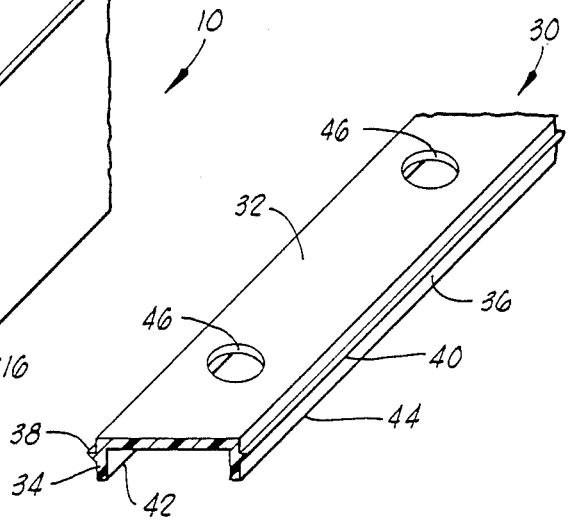
FIG. 2 is a perspective view of an insert strip as constructed in accordance with the invention.

As shown in FIG. 2, the insert strip 30 consists of a shallow U-shaped member having a panel 32 with right angle side panels 34 and 36, side panels 34 and 36 being relatively short in comparison with the width of panel 32. The insert strip 30 may also be extruded in any selected lengths in the same manner as mounting member 10. A pair of angular side ridges 38 and 40 are formed along side panels 34 and 36 at a selected spacing equidistant from respective bottom edges 42 and 44 for accommodation when snap-fit into the bottom of mounting member 10 for engagement in respective grooves 26 and 28. The insert strip 30 is then formed with a plurality of spaced holes 46 along the center of panel 32 for the purpose of receiving lamp sockets upward therethrough, as will be further described.

Figure 3:
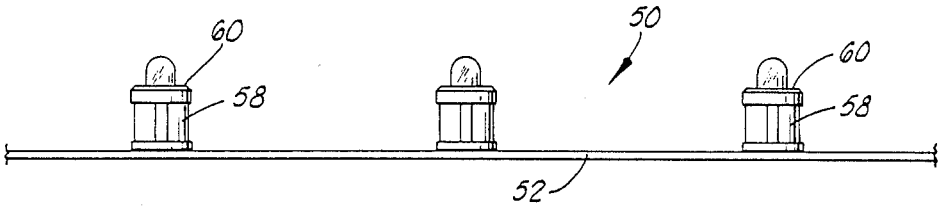
FIG. 3 is a side view in elevation of a light strip, a prior art type that is commercially available, as utilized with the invention.
Figure 4:
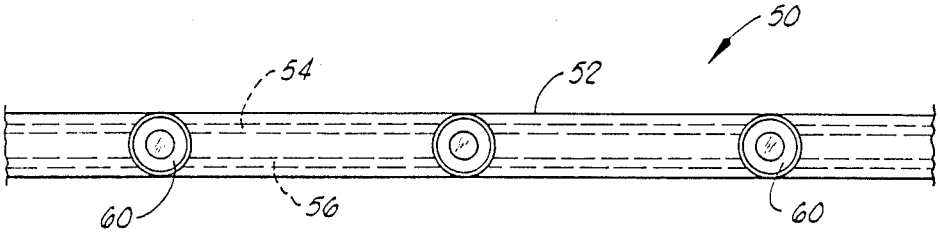
FIG. 4 is a top plan view of the light strip.

FIGS. 3 and 4 illustrate a light strip 50, a component of the present invention which is commercially available from Toki Industries of Tokyo, Japan. The light strip 50 consists of a flexible plastic ribbon 52 having embedded therein conductors 54 and 56 extending in spaced, parallel disposition. A plurality of lamp sockets 58 with inserted lamp assemblies 60 are then secured in conductive connection at selected spaced positions along ribbon 52. Such light strips 50 are available in any of a number of different lamp spacings and wattage ratings.

Figure 5:
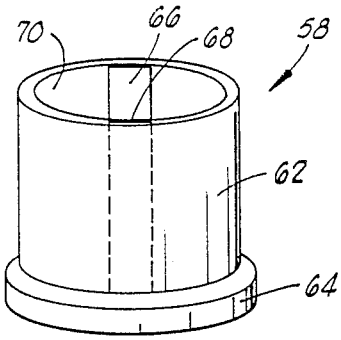
FIG. 5 is a perspective view in elevation of an individual lamp socket of the light strip.
Figure 6:
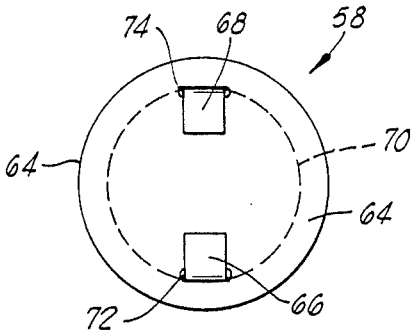
FIG. 6 is a bottom view of the lamp socket of FIG. 5.

FIGS. 5 and 6 illustrate the lamp socket 58 in greater detail. Thus, socket 58, as may be formed from a suitable plastic, consists of a cylindrical barrel 62 formed into a wider diameter bottom base 64. A pair of metallic conductor strips 66 and 68 are disposed down opposite sides of a socket inner cylindrical surface 70 thereby to define opposing flats for contact with wires of a mating lamp assembly 60 (to be described). The conductor strips 66 and 68 are led down through opposite side slots 72 and 74 and folded over centrally to provide securing contacts for connection to the conductors 54 and 56 within ribbon 52 (FIG. 4). Secure conductive connection may be made by such as spot welding or high heat solder techniques.

Figure 7:
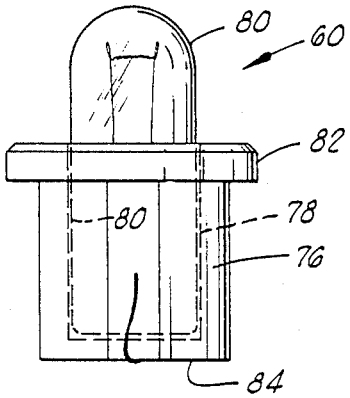
FIG. 7 is a side view in elevation of the lamp socket with lamp.
Figure 8:
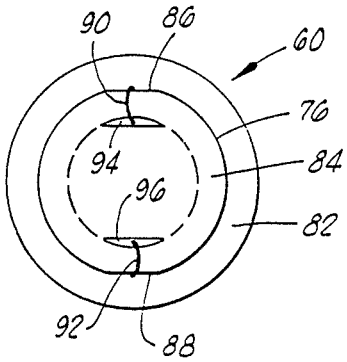
FIG. 8 is a bottom view of the lamp socket with lamp as shown in FIG. 7.

Referring to FIGS. 7 and 8, the lamp assembly 60 is formed with a cylindrical lamp base 76 of diameter to fit securely within inner wall 70 of lamp socket 58, and base 76 includes a bore 78 for receiving a lamp 80 downward therein. The lamp base 76 is formed with a suitable collar 82 which serves to provide a gripping surface for removal of the lamp assembly 60 from lamp socket 58.

Referring to the bottom view, (FIG. 8) of lamp assembly 60, it may be noted that lamp base 76 is formed with opposite-side flats 86 and 88 which serve both to properly orient lamp assembly 60 for conductive insertion within socket 58, as well as to provide a bearing surface for maintaining lamp conductors 90 and 92 in contact with the flat socket conductors 66 and 68 (FIGS. 5 and 6). The lamp exciter conductors 90 and 92 extend downward from lamp 80 through respective slots 94 and 96 in the bottom surface 84 of cylindrical socket 76. The conductor wires 90 and 92 are then simply folded upward along flats 86 and 88 for insertion within the socket 58 in conductive connection.

Figure 9:
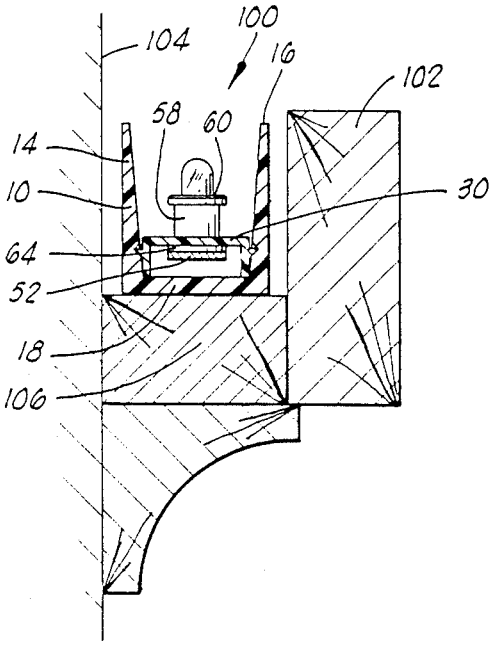
FIG. 9 is an end view in elevation showing installation of a plural lamp light strip in one form of cove molding application.

Referring to FIG. 9, an assembled lamp fixture 100 is shown as assembled for operation within a cove assembly 102 adjacent a wall 104. The lamp fixture 100 would be constructed of whatever the requisite length for the particular cove assembly as insert strip 30 carrying a plurality of lamp assemblies 60 within mounting member 10. The mounting member 10 is secured with base panel 18 fastened to a horizontal portion 106 of cove assembly 102 while sidewalls 14 and 16 extend upward an equal distance. This assures that the indirect light radiation emanates primarily straight upward along wall 104 towards the overhang, ceiling or whatever. The mounting member 10 is preferably formed from a PVC material having high reflection characteristics so that good illumination is achieved. The illumination may also be varied in accordance with selection of the number of lamp assemblies 60 and/or their spacing per unit length along the light strip 50.

Figure 10:
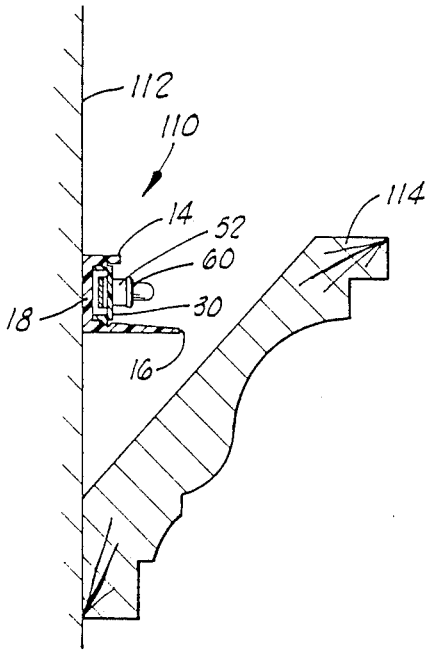
FIG. 10 is an end view in elevation showing an altered form of plural lamp light strip in another type of cove molding application.

FIG. 10 illustrates an altered form of lamp fixture 110 as affixed to a wall 112 within a cove molding 114. In this case, the mounting member base 18 is secured flat against the wall 112 and the upper side wall 14 is trimmed off below the level of lamp assembly 60. In this application, illumination from lamp assembly 60 is given wider direct illumination as well as greater reflective area to contribute a more muted overall effect to the upward illumination.

The foregoing discloses a novel form of plural lamp fixture for use in indirect lighting that is capable of a large number of different effects by mere adjustment of positioning or trimming and re-shaping of the fixture itself. While reference has been made to specific materials and extrusion design characteristics, it should also be understood that variations of extrusion cross section are within contemplation. Fixtures for use on curved surfaces are readily fitted either by kerfing straight stock or molding the components to fit a complementary surface.

Changes may be made in combination and arrangement of elements as heretofore set forth in the specification and shown in the drawings; it being understood that changes may be made in the embodiments disclosed without departing from the spirit and scope of the invention as defined in the following claims.

What is claimed is:

1. A lighting fixture for indirect lighting applications comprising:

a mounting member in the form of an elongated generally U-shaped extrusion of reflective material having a base panel and right angularly extending side panels having inner and outer surfaces, each of said side panel inner surfaces being formed with an elongated groove extending therealong proximate and equi-distant from said base panel, and being formed as diverging angular surfaces proceeding outward from adjacent said respective elongated grooves;

an insert strip in the form of an elongated panel having a plurality of spaced holes formed therealong and including ridge means on each side for mating engagement in the respective base member grooves; and a light strip having plural lamp assemblies mounted thereon in spacing similar to said insert strip spaced holes, said light strip being disposed between the insert strip and mounting member base panel and extending respective lamp assemblies through said spaced holes.

2. A lighting fixture as set forth in claim 1 wherein said insert strip is further characterized in that:

said insert strip elongated panel includes opposite side right angle side panels, each of which has said ridge means formed thereon, said side panels being adapted for insertion toward the base panel when the insert strip is in secured position thereby to define a space between the elongated panel and the mounting member base panel.

3. A lighting fixture as set forth in claim 1 wherein said light strip is further characterized in that:

said light strip includes a pair of electric conductors with each of said plural lamp assemblies connected in parallel.

4. A lighting fixture as set forth in claim 3 wherein:

said plural lamp assemblies each consist of a lamp socket and lamp that is removable and replaceable while said mounting member and insert strip remain in ridge means-to-groove assembly.

5. A light fixture as set forth in claim 1 wherein:

a portion of at least one mounting member side panel is uniformly removed along the length thereof in order to increase the amount of both direct and reflected light external to said mounting member.

6. A lighting fixture as set forth in claim 1 wherein each of said light strip plural lamp assemblies further comprises:

a lamp socket for secure insertion through said spaced holes; and a lamp removeably inserted in said lamp socket.

* * * * *